US008757141B2

(12) United States Patent
Grobleben

(10) Patent No.: US 8,757,141 B2
(45) Date of Patent: Jun. 24, 2014

(54) EXTRACTOR HOOD

(75) Inventor: Ralf Grobleben, Bretten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 775 days.

(21) Appl. No.: 12/513,885

(22) PCT Filed: Oct. 31, 2007

(86) PCT No.: PCT/EP2007/061755

§ 371 (c)(1),
(2), (4) Date: May 7, 2009

(87) PCT Pub. No.: WO2008/055837

PCT Pub. Date: May 15, 2008

(65) Prior Publication Data

US 2010/0043772 A1 Feb. 25, 2010

(30) Foreign Application Priority Data

Nov. 10, 2006 (DE) ..... 10 2006 053 076

(51) Int. Cl.
*F24C 15/20* (2006.01)

(52) U.S. Cl.
USPC ..... 126/299 D; 126/299 R; 126/21 R; 454/3; 454/12; 454/41

(58) Field of Classification Search
USPC ..... 126/299 D, 299 R, 21 R; 55/DIG. 36; 454/3, 12, 41, 2, 5, 134, 145, 212
See application file for complete search history.

(56) References Cited

U.S. PATENT DOCUMENTS

| | | | | |
|---|---|---|---|---|
| 3,087,411 | A | 4/1963 | Spear et al. | |
| 3,557,497 | A * | 1/1971 | Schafer et al. | 52/1 |
| 3,695,164 | A * | 10/1972 | Stalker | 126/299 D |
| 3,834,295 | A * | 9/1974 | Seidel | 126/299 D |
| 3,858,568 | A * | 1/1975 | Seidel | 126/299 R |
| 3,890,887 | A * | 6/1975 | Kaufman et al. | 126/299 D |
| 4,742,766 | A * | 5/1988 | Davison et al. | 454/5 |
| 4,821,629 | A * | 4/1989 | Davison et al. | 454/5 |
| 5,797,791 | A * | 8/1998 | Humphrey et al. | 454/134 |
| 6,216,686 | B1 * | 4/2001 | Chiu | 126/299 R |
| 6,223,741 | B1 * | 5/2001 | Panos | 126/299 E |
| 6,622,717 | B1 * | 9/2003 | Kim | 126/299 D |
| 2004/0194777 | A1 * | 10/2004 | Antoniello | 126/299 R |
| 2005/0051158 | A1 | 3/2005 | Klemm et al. | |

FOREIGN PATENT DOCUMENTS

| | | | |
|---|---|---|---|
| DE | 10238904 | A1 | 3/2004 |
| DE | 10245403 | B3 | 4/2004 |
| DE | 102005055029 | A1 | 5/2007 |
| DE | 102006005806 | A1 | 8/2007 |
| EP | 1394473 | A2 | 3/2004 |

* cited by examiner

*Primary Examiner* — Avinash Savani
(74) *Attorney, Agent, or Firm* — James E. Howard; Andre Pallapies

(57) ABSTRACT

An extractor hood including a housing, a vapor shield pivotably mounted on the housing, and at least one pivot bearing connecting the vapor shield to the housing. The at least one pivot bearing has a bearing axis in a vicinity of a center of gravity of the vapor shield.

11 Claims, 5 Drawing Sheets

EXTRACTOR HOOD

The present invention relates to an extractor hood.

BACKGROUND OF THE INVENTION

DE 102 38 904 A1 describes an extractor hood device, where the vapor shield can be adjusted to suit differing heights of user. To this end an adjustment device is provided, by means of which the position of the vapor shield can be adjusted within a predefined area of adjustment relative to the housing of the extractor hood. The adjustment devices are realized as jointed devices on the sides of the housing and further guides integrated therein, or separately provided.

The proposed extractor hood device has the particular disadvantage that a relatively large amount of manual force must be applied in order to pivot the vapor shield, or the device must include a motor drive, by means of which the vapor shield can be pivoted.

SUMMARY OF THE INVENTION

The object of the present invention is thus in particular to create an extractor hood which can be adapted to different environmental conditions in a simple manner.

According to the invention, this object is achieved by an extractor hood comprising a housing and a vapor shield which is pivotably mounted on the housing. The extractor hood is characterized in that the vapor shield is connected to the housing by means of at least one bearing, representing a pivot bearing, and the bearing axis of the at least one bearing lies in the vicinity of the center of gravity of the vapor shield.

For the purposes of this invention, the center of gravity of the vapor shield is in particular designated as the geometric center of gravity of the vapor shield. In the case of an even vapor shield with consistent material thickness, the center of gravity thus corresponds to the centroid of the vapor shield. In the case of a vapor shield whose material thickness varies across its surface, the center of gravity can however diverge from the centroid. In this case the center of gravity is the center of mass of the vapor shield.

According to the invention, the bearing axis is defined by the at least one bearing, which is formed by a bearing device provided on the housing and/or the vapor shield, and exclusively permits the pivoting of the vapor shield relative to the housing. If a number of bearings are provided for on the extractor hood, the bearing axes of these bearings coincide. The bearing axis in the vapor shield preferably runs in its width direction. Parts of a bearing device can thus, for example, be provided on two opposite lateral surfaces of the housing, and there in each case engage with the vapor shield or a further part of the bearing device provided thereon. For the purposes of this invention, the geometric line around which the vapor shield can be pivoted against the housing is designated as the bearing axis.

In that only one bearing axis for movement of the vapor shield relative to the housing is provided, that is to say all bearings provided on the extractor hood, by means of which the vapor shield is connected to the housing of the extractor hood, are oriented relative to each other in such a way that their axes coincide, less force is required to move the vapor shield around this bearing axis than in the case of the existence of a number of bearing axes or guides distributed across the depth of the vapor shield or of the housing, around or along which the vapor shield must be moved. As the bearing axis is additionally provided in the vicinity of the center of gravity of the vapor shield, the weight of the vapor shield does not come into play when moving the vapor shield, and the force required to move the vapor shield around the bearing axis is thus further reduced. In that the bearing is additionally for a pure pivot bearing, and thus permits only rotation of the vapor shield around the bearing axis, the lever arm between the bearing axis and the center of gravity can be kept constant. Frictional forces arising in adjustment devices of the prior art as a result of the displacement of the vapor shield in a jointed bearing are also avoided in the case of the inventive extractor hood. Finally in the case of bearings used according to the invention, the construction of the bearing is significantly simplified by comparison with bearings in which a displacement of the vapor shield is enabled in addition to pivoting movement.

In addition to the inventive mounting of the vapor shield on the housing, a seal can be provided between these two components, which does not however serve to guide or mount the vapor shield, but is intended solely to prevent the passage of fumes through a gap existing between the components.

The bearing axis of the at least one bearing preferably runs through the center of gravity of the vapor shield. In this embodiment, the lever arm between the bearing axis and the center of gravity of the vapor shield is reduced to zero. In this embodiment and as a result of the fact that no further offset bearing or guide is provided, there is no resistance to the movement of the vapor shield around the bearing axis.

According to one embodiment, the bearing axis runs along the front of the housing of the extractor hood. In this embodiment of the extractor hood, the connection of the vapor shield with the housing can be realized via a single bearing device. This embodiment additionally has the advantage that the components to be provided for mounting of the vapor shield can be arranged on the edges of the housing and/or of the vapor shield, and thus no further fixing apertures, for example in the lateral surfaces of the housing, are necessary. This simplifies the manufacture of the extractor hood and at the same time reduces the number of surfaces and/or projections and the complexity of the same, on which impurities could be deposited during use of the extractor hood. In this embodiment the extractor hood additionally has an improved visual appearance, as neither fixing apertures nor mountings need be provided on the vapor shield or the housing positioned at a distance from the edges or margins of the housing and/or the vapor shield.

The bearing device, which comprises the at least one bearing, extends, according to one embodiment, across the entire width of the housing. The connection between the vapor shield and the housing is thereby particularly stable. The construction of the extractor hood is thereby simple, as only one bearing device is required, even in the case of multiple bearings distributed over the bearing axis. This embodiment is particularly preferable in the case where the center of gravity lies at the front of the housing, and the bearing axis runs through this center of gravity, as in this case the bearing device can be provided along the front of the housing, and no special fixing apertures are to be provided on the housing.

A latching mechanism is preferably provided on the bearing between the housing and the vapor shield. This latching mechanism serves to retain the vapor shield in a set position. The latching mechanism can be a mechanism based on frictional forces. It is however also possible that the latching mechanism has latching stages, which prescribe particular positions which can be assumed by the vapor shield. Through the provision of a latching mechanism, autonomous movement of the vapor shield from a set position into a starting position can be prevented. Nevertheless, only minimal force is required to move the vapor shield from this starting position or another position, as the weight of the vapor shield and the resultant weight force can essentially be ignored in the case of the inventive extractor hood. The latching mechanism can be integrated into the bearing device, or however have an effect from outside on at least one part of the bearing device.

Additionally or alternatively a damping function can be provided for the latching mechanism, by means of which the movement of the vapor shield relative to the housing can be damped. The damping can be provided in the bearing and/or on the bearing around which the vapor shield can be moved.

According to one embodiment a stop for the vapor shield is at least partially provided on the upper edge of the side walls of the housing. The stop is preferably provided only between the position of the bearing axis and the rear wall of the housing. According to one embodiment, the stop is realized by means of a flue arranged above the housing, whose width is greater than the width of the housing. By means of the interruption created between the housing and the flue, the vapor shield can strike the underside of the flue and be retained there. As a result of this embodiment, any latching mechanism to be provided on the bearing is simplified, as the starting position of the vapor shield is determined by the stop, and no latching is to be provided for this position.

The stop is preferably at an angle of 15° to the horizontal. The vapor shield, which is connected to the housing in the vicinity of its center of gravity is guided, by means of the stop, out of the horizontal position which the vapor shield would assume without the stop, and thus lies reliably against the stop.

Alternatively or in addition to the stop realized by means of the underside of the flue, a stop bolt can also be provided on the housing. By means of this bolt, movement of the vapor shield around the provided bearing can be restricted. The stop bolt is here preferably to be provided in the rear area of the housing.

According to one embodiment, the housing has at least one intake aperture on the side walls, which lies below the height at which the bearing is arranged on the housing, and in the case of a raised position of the vapor shield lies partially above the vapor shield, at least in the rear area.

By means of such an arrangement of intake apertures on the side walls of the housing, reliable suction of vapor can also be guaranteed in the case of a raised vapor shield. The raised position of the vapor shield is here defined as that position in which the vapor shield has been moved upwards at its front relative to a starting position. The rear of the vapor shield is here located below the position which this assumes in the starting position. By means of the intake apertures in the side walls of the housing, vapor which in the raised position of the vapor shield flows past its rear is, to a still sufficient degree, sucked into the housing and conveyed away. Additional sealing of the vapor shield at the rear abutting the wall to which the extractor hood is fixed, is thus not necessary. The intake apertures can be realized as slits in the side wall of the housing. It is, however, also within the scope of the invention that the intake apertures are implemented by means of perforations in the lateral surfaces of the housing.

BRIEF DESCRIPTION OF THE DRAWINGS

The invention is explained once more below, with reference to the attached drawings, where.

DETAILED DESCRIPTION OF THE EXEMPLARY EMBODIMENTS OF THE PRESENT INVENTION

Figure 1:
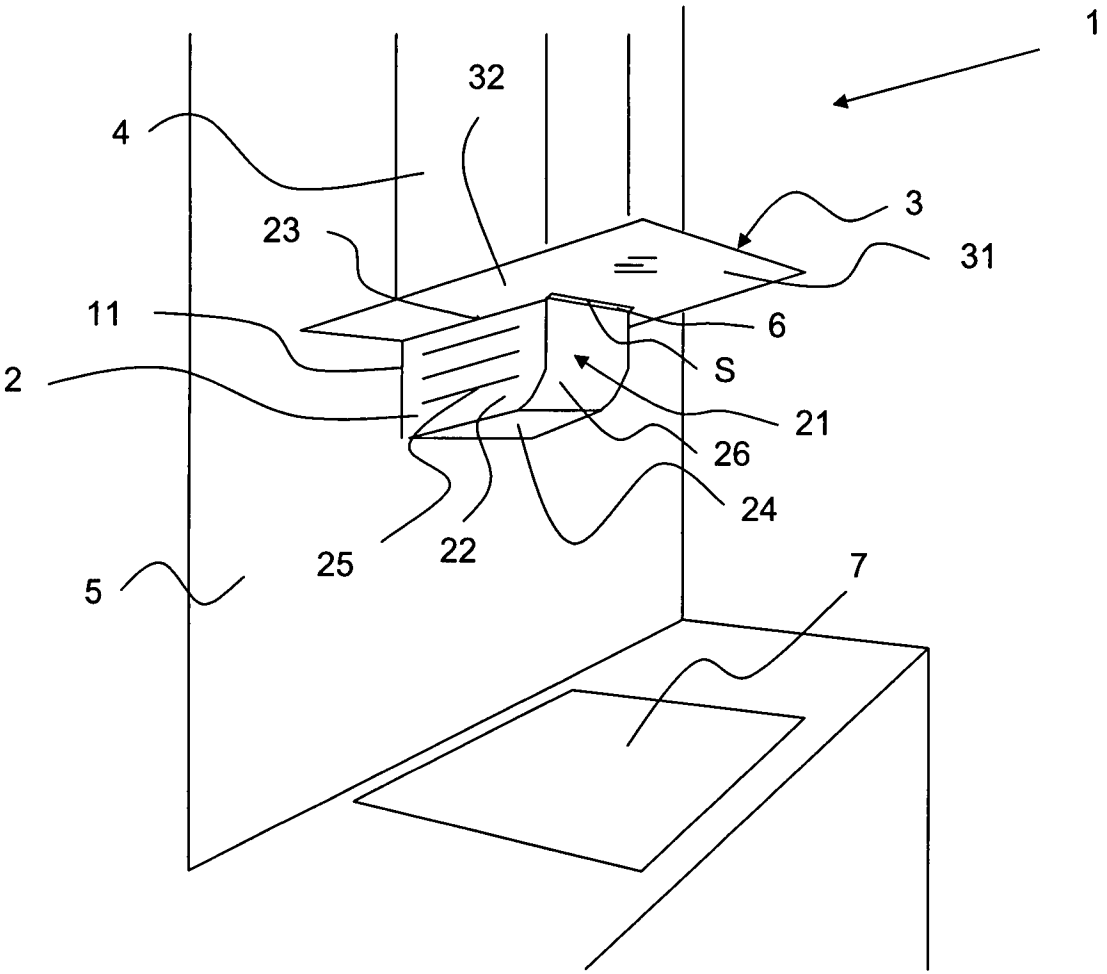
FIG. 1: shows a diagrammatic 3-dimensional view of an embodiment of the inventive extractor hood.

FIG. 1 shows one embodiment of the inventive extractor hood 1. The extractor hood 1 comprises a housing 2 and a vapor shield 3 surrounding this at the front 21 and both lateral surfaces 22. In the embodiment represented a flue 4 is additionally shown, which connects to this above the housing 2.

The extractor hood 1 represents a wall chimney, which at its rear 11 is fixed to a wall 5, which can represent the kitchen wall. In the embodiment represented, the vapor shield 3 is provided on the upper edge 23 of the housing 2.

On its underside the housing 2 has an exhaust aperture 24 and intake apertures 25 provided on the lateral surfaces 22, which are represented in the form of slits. On the front 21 of the housing 2 a cover plate 26 is provided below the vapor shield 3. This runs downwards from the vapor shield 3 and in the embodiment shown is curved toward the exhaust aperture 24 on the underside of the housing 2.

In the embodiment represented, the vapor shield 3 is embodied as a flat plate. The form of the vapor shield 3 seen from above is essentially U-shaped, where the base 31 of the U-shape runs along the front 21 of the housing 2 and the two arms 32 of the U-shape in each case run along the lateral surfaces 22 of the housing 2 in the direction of the rear 11 of the extractor hood. On the side of the base 31 of the vapor shield 3 facing the housing 2 is arranged a bearing device 6 for mounting of the vapor shield 3 on the housing 2 of the extractor hood 1. The bearing device 6 runs through the center of gravity S of the vapor shield 3.

Shown below the extractor hood 1 in diagrammatic form is a cooking zone 7, from which vapor can rise during a cooking process, and subsequently be sucked in through the extractor hood 1.

In FIG. 1 the vapor shield 3 is oriented in a starting position. This starting position is described more precisely below, with reference to FIG. 2. The upper surface 321 of the arm 32 of the vapor shield 3 here lies on the underside 41 of the flue 4. The underside 41 of the flue 4 runs obliquely downwards on its side walls 42 from the front 43 of the flue 4 to the rear 11 of the extractor hood 1.

On the front 21 of the housing 2 is arranged a bearing device 6, by means of which the vapor shield 3 is attached to the housing 2, and via which the vapor shield 3 can be pivoted relative to the housing 2.

In the embodiment shown, the vapor shield 3 is located in the starting position. As a result of the bevels formed on the underside 41 of the flue 4, which runs between the bearing device 6 and the rear 11 of the extractor hood 1, the vapor shield 3 in the starting position is pivoted upwards by an angle a relative to the horizontal H to the front of vapor shield. Angle a can, for example, lie in the range between 10° and 20°, and is preferably 15°.

Figure 3:
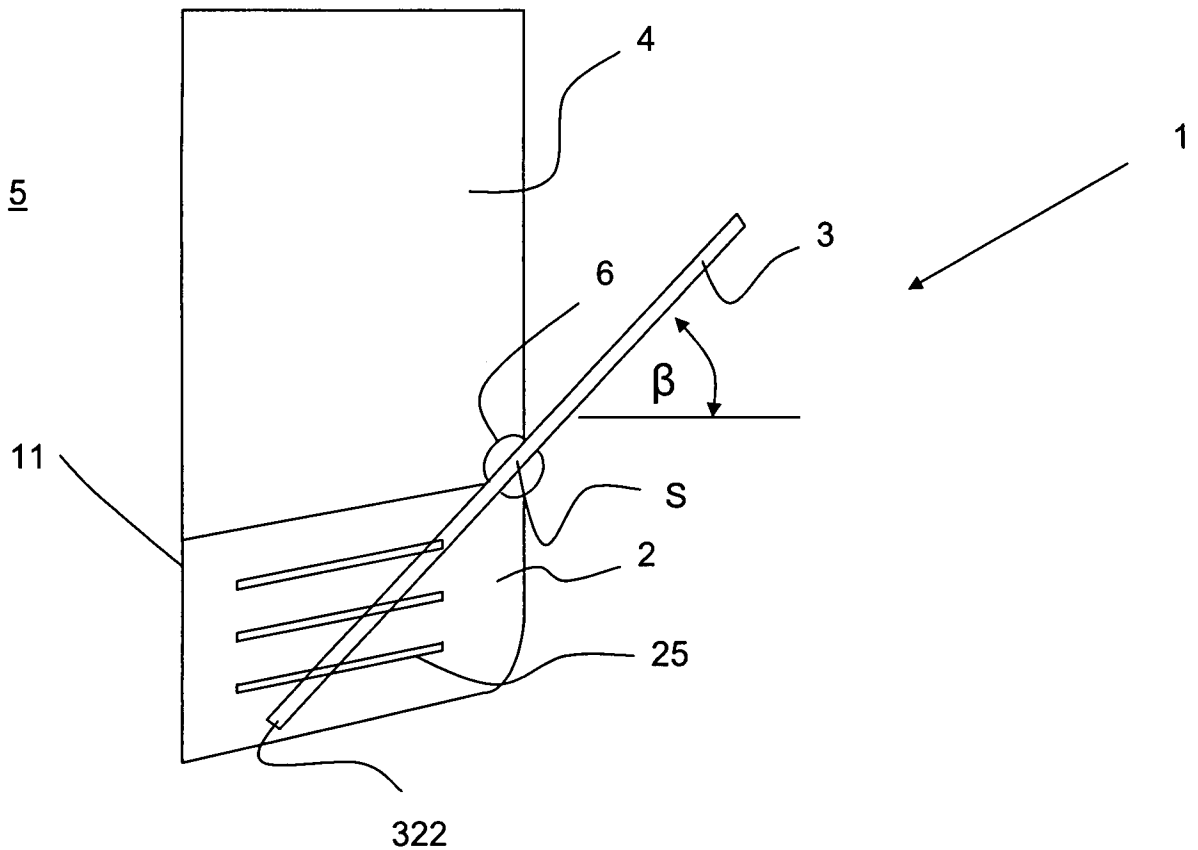
FIG. 3: shows a diagrammatic side-view of the embodiment of the extractor hood according to FIG. 1 with the vapor shield in a raised position.

FIG. 3 shows the extractor hood 1 with the vapor shield 3 in the raised, that is to say upper end position. The front of the vapor shield 3 is here raised relative to the starting position and as a result of the vapor shield 3 being fixed to the housing the rear of the vapor shield 3 is pivoted downwards accordingly. As the bearing device 6 or the joint between the vapor shield 3 and the housing 2 is arranged in the vicinity of the center of gravity S of the vapor shield 3, pivoting the vapor shield 3 from the starting position into the raised position or an intermediate position requires only a small amount of force, and can thus be carried out manually.

As can be seen from FIG. 3, with the vapor shield 3 in its raised position, the rear end of the vapor shield 3, in particular the rear end 322 of the arm 32 of the vapor shield 3, lies at a distance from the rear 11 of the extractor hood 1 and thus at a distance from the wall 5 on which the extractor hood 1 is mounted. In this position, part of the suction surfaces 25 provided on the lateral surfaces 22 of the housing 2 lies above the vapor shield 3. Vapor flowing toward the extractor hood 1 from below can thus not be directed along the vapor shield 3 to the exhaust aperture 24 provided on the underside of the housing 2. However because the intake apertures 25 on the side walls 22 are available to suck in vapor independently of the position of the vapor shield 3, vapor flowing past the rear 322 of the vapor shield 3 can still be extracted above the vapor shield 3 or behind the vapor shield 3.

Figure 2:
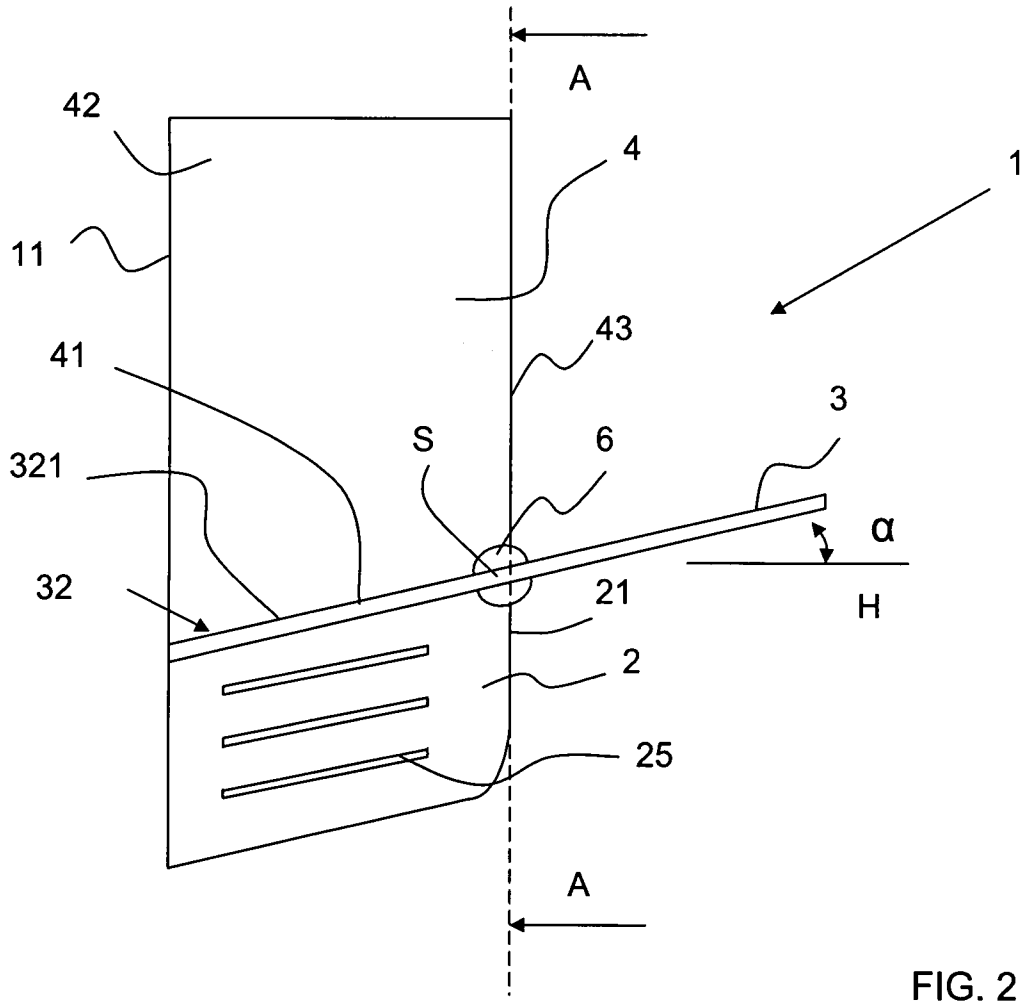
FIG. 2: shows a diagrammatic side-view of an embodiment of the extractor hood according to FIG. 1 with the vapor shield in a starting position.
Figure 4:
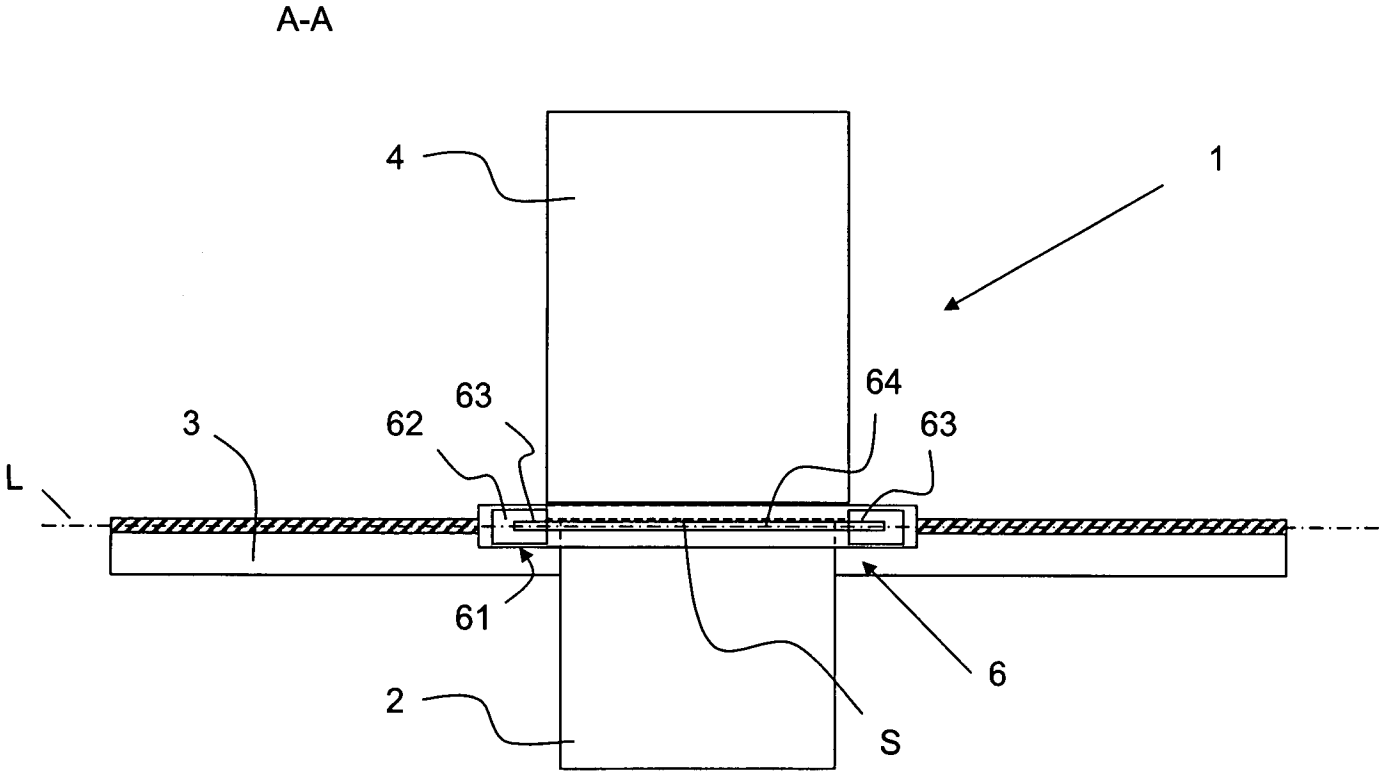
FIG. 4: shows a diagrammatic sectional view of the extractor hood along the section A-A in FIG. 2.

FIG. 4 shows a diagrammatic section through the extractor hood along the section line A-A in FIG. 2. A possible structure of the bearing device 6 can be recognized from this view. In this embodiment, the bearing device 6 comprises two bearings 61, which are arranged in the area of the left and right end of the of the bearing device 6 which extends longitudinally essentially in a horizontal manner. Each bearing 61 comprises a bearing bushing 62, which is connected immovably to the vapor shield 3. Further, each bearing 61 comprises the protrusion 63 of a bearing shaft 64. Between the bearing bushing 62 and the protrusion is formed the pivot bearing for a rotational movement of the vapor shield 3 relative to the housing 2. The bearing axis L of the two bearings 61 runs through the center of gravity S of the vapor shield 3.

Figure 5:
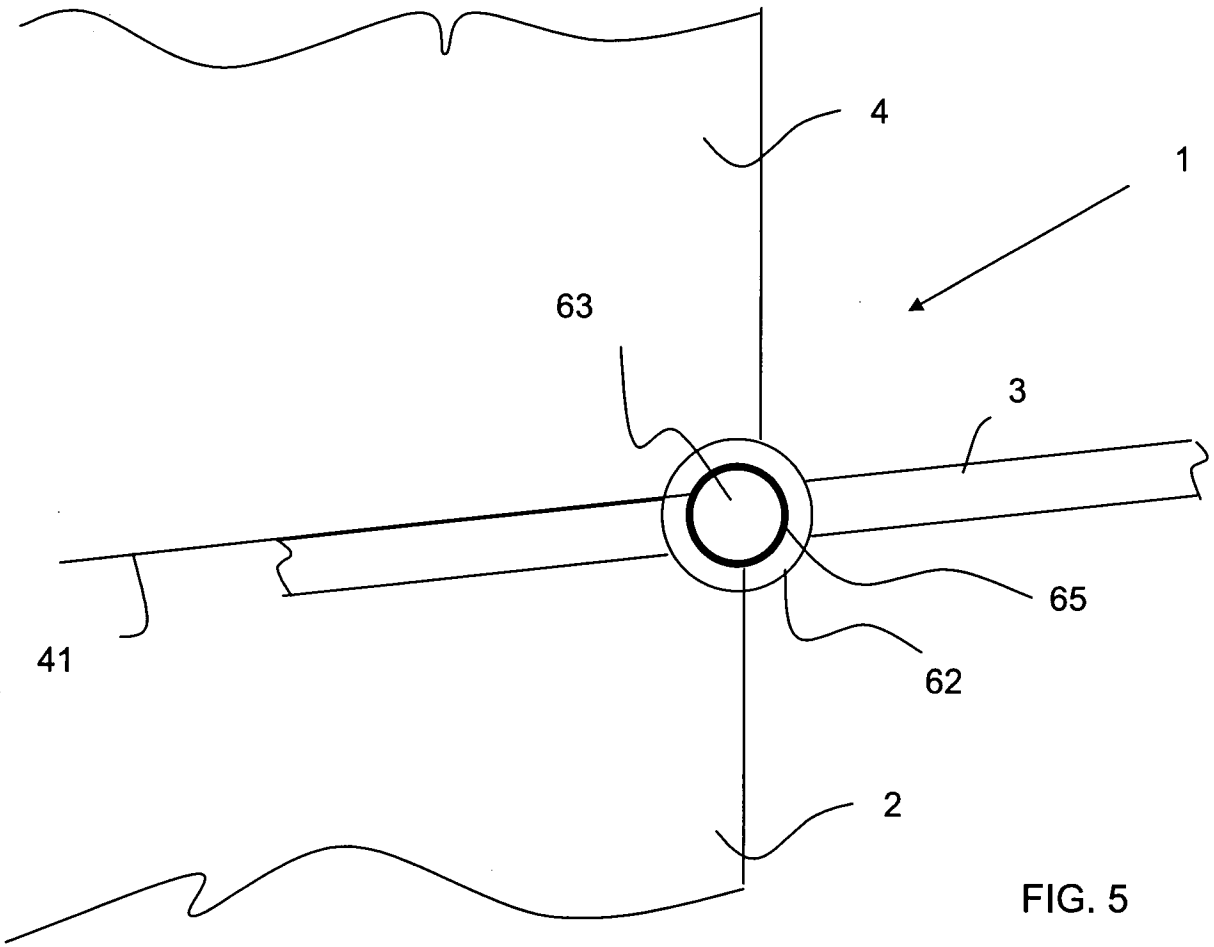
FIG. 5: shows a diagrammatic sectional view of the extractor hood in the area of a joint.

FIG. 5 shows a section through a possible structure of the bearing 61. A friction layer 65 is hereby provided between the protrusion 63 and the bearing bushing 62. A frictional force which retains the vapor shield 3 in a position set by the user is generated by means of the friction layer 65, which is affixed to the inner face of the bearing bushing 62 or the outer face of the protrusion 63.

The present invention is not limited to the embodiments represented. The bearing device and the bearing can in particular have structural details at variance with those described. The bearing can, for example, be realized by means of a bolt and a bushing encompassing the same, wherein the bolt is fixed to the side of the housing, and thus does not represent a bearing shaft. Furthermore a bolt can also, for example, be provided on the vapor shield, and can interact with a corresponding recess on the housing as a bearing.

The present invention offers a simple possibility for moving the vapor shield of an extractor hood out of the user's working area. According to the invention the pivot point of the vapor shield is here placed at the center of gravity of the vapor shield. A modest technical effort is hereby guaranteed to ensure the mobility and arresting of the vapor shield. The position of the inventively mounted vapor shield in relation to its angle to the wall and to the housing can be moved by the user without additional motors or springs.

The invention claimed is:

1. An extractor hood comprising: a housing having an exhaust opening in an underside of the housing; a vapor shield pivotably mounted to the housing and projecting beyond at least one outer side wall of the housing, the vapor shield having a generally planar body having a base portion and an arm portion extending away from the base portion and along a lateral side of the housing, with the base portion extending along a front of the housing, with the base portion and the arm portion being coplanar, wherein the shield does not cover any portion of the exhaust opening in the housing throughout a range of motion of the shield; and at least one pivot bearing connecting the vapor shield to the housing, wherein the at least one pivot bearing has a bearing axis proximate the center of gravity of the vapor shield and extending intermediate the base portion and the arm portion.

2. The extractor hood as claimed in claim 1, wherein the bearing axis of the at least one pivot bearing extends through the center of gravity of the vapor shield.

3. The extractor hood as claimed in claim 1, wherein the bearing axis of the at least one pivot bearing extends along a front of the housing of the extractor hood.

4. The extractor hood as claimed in claim 1, wherein the at least one pivot bearing is included in a bearing device, and wherein the bearing device extends over an entire width of the housing.

5. The extractor hood as claimed in claim 1, and further comprising:

a latching mechanism on the at least one pivot bearing.

6. The extractor hood as claimed in claim 1, and further comprising:

a stop on an upper edge of side walls of the housing.

7. The extractor hood as claimed in claim 6, wherein a flue is arranged above the housing, and wherein the stop includes a lower edge of the flue.

8. The extractor hood as claimed in claim 7, wherein the lower edge of the flue extends at a downward angle from a position of the at least one pivot bearing to a rear of the extractor hood.

9. The extractor hood as claimed in claim 1, wherein the housing includes:

a plurality of side walls, and at least one intake aperture on the plurality of side walls, wherein the at least one intake aperture is below a height at which the at least one pivot bearing is arranged on the housing, and wherein at least a rear area of the housing is partially above the vapor shield when the vapor shield is in a raised position.

10. An extractor hood comprising: a housing; a vapor shield pivotably coupled to the housing and projecting beyond at least one outer side wall of the housing such that a front of the vapor shield is movable between a starting position and one of a raised end position and an intermediate position, the vapor shield having a generally planar U-shaped body formed from a base portion extending along a front wall of the housing and a pair of arm portions extending laterally away from the base portion with each arm extending along a separate side wall of the housing, and with the base portion and the arm portions being coplanar; and at least one pivot bearing connecting the vapor shield to the housing, wherein a bearing axis of the at least one pivot bearing is proximate the center of gravity of the vapor shield and extends intermediate the base portion and the arm portions.

11. An extractor hood comprising: a housing having an exhaust opening; a vapor shield pivotably mounted to the housing and projecting beyond at least one outer side wall of the housing, the vapor shield having a generally planar body having a base portion and an arm portion extending away from the base portion along a lateral side of the housing, with the base portion extending across and away from a front of the housing, wherein the shield does not obstruct the exhaust opening in the housing; at least one pivot bearing connecting the vapor shield to the housing; and a stop on an upper edge of side walls of the housing wherein the at least one pivot bearing has a bearing axis proximate the center of gravity of the vapor shield and extending intermediate the base portion and the arm portion.

* * * * *